US010227168B2

(12) United States Patent
Coon et al.

(10) Patent No.: US 10,227,168 B2
(45) Date of Patent: Mar. 12, 2019

(54) LID HAVING A DUAL CAMMED SEAL ARM ASSEMBLY

(71) Applicant: IGNITE USA, LLC, Chicago, IL (US)

(72) Inventors: Robert C. Coon, Chicago, IL (US); Alexander Garfield, Chicago, IL (US)

(73) Assignee: IGNITE USA, LLC, Chicago, IL (US)

( * ) Notice: Subject to any disclaimer, the term of this patent is extended or adjusted under 35 U.S.C. 154(b) by 365 days.

(21) Appl. No.: 15/060,244

(22) Filed: Mar. 3, 2016

(65) Prior Publication Data

US 2017/0253397 A1 Sep. 7, 2017

(51) Int. Cl.

| | |
|---|---|
| ***B65D 47/32*** | (2006.01) |
| ***A47G 19/22*** | (2006.01) |
| ***B65D 43/02*** | (2006.01) |
| ***B65D 43/14*** | (2006.01) |
| ***B65D 45/20*** | (2006.01) |
| ***B65D 47/06*** | (2006.01) |
| ***B65D 51/18*** | (2006.01) |

(52) U.S. Cl.

CPC ..... *B65D 47/32* (2013.01); *A47G 19/2272* (2013.01); *B65D 43/02* (2013.01); *B65D 43/14* (2013.01); *B65D 45/20* (2013.01); *B65D 47/06* (2013.01); *B65D 51/18* (2013.01); *B65D 2251/009* (2013.01); *B65D 2251/0018* (2013.01); *B65D 2251/0028* (2013.01); *B65D 2251/0081* (2013.01); *B65D 2251/0087* (2013.01); *B65D 2543/00046* (2013.01)

(58) Field of Classification Search

CPC ..... A47G 19/2272; B65D 2205/02; B65D 2251/0018; B65D 2251/0028; B65D 2251/0081; B65D 2251/0087; B65D 2251/009; B65D 2543/00046; B65D 47/06; B65D 51/1644; B65D 51/165

USPC ..... 220/254.1, 254.4, 254.5, 254.9; D7/900

See application file for complete search history.

(56) References Cited

U.S. PATENT DOCUMENTS

| | | | | |
|---|---|---|---|---|
| 6,116,476 | A * | 9/2000 | Huang | B65D 47/249 222/506 |
| 6,626,314 | B1 * | 9/2003 | McHenry | B65D 47/265 220/254.2 |
| 7,073,678 | B1 * | 7/2006 | Dibdin | A47G 19/2272 220/254.1 |
| 8,668,106 | B1 * | 3/2014 | Joy | A47G 19/2266 220/254.3 |
| 9,745,105 | B2 * | 8/2017 | Parekh | A45F 3/16 |

(Continued)

*Primary Examiner* — Anthony Stashick
*Assistant Examiner* — Kaushikkumar Desai
(74) *Attorney, Agent, or Firm* — Marshall, Gerstein & Borun LLP

(57) ABSTRACT

A liquid container lid includes a seal arm assembly that stages opening and closing of a vent hole relative to a drink hole so that vapor within the liquid container may be vented to the atmosphere before the drink hole is opened. The liquid container lid and seal arm assembly reduce or eliminate the possibility of a consumer being injured by the hot vapor exiting through the drink hole due to excess gas pressure within the liquid container. The seal arm assembly is operatively connected to a cap of the liquid container lid so that the seal arm assembly is actuated by rotation of the cap. As the cap is turned in one direction, the seal arm assembly opens the vent hole before opening the drink hole. As the cap is turned in a second direction, the seal arm assembly closes the drink hole before closing the vent hole.

14 Claims, 9 Drawing Sheets

(56) References Cited

U.S. PATENT DOCUMENTS

| | | | | |
|---|---|---|---|---|
| 2013/0056467 | A1* | 3/2013 | Shepard | A47G 19/2272 220/254.9 |
| 2013/0119060 | A1* | 5/2013 | Chiou | B65D 43/02 220/254.3 |
| 2013/0213966 | A1* | 8/2013 | Steininger | B65D 47/265 220/253 |
| 2015/0164255 | A1* | 6/2015 | Coon | B65D 47/241 220/254.3 |

* cited by examiner

LID HAVING A DUAL CAMMED SEAL ARM ASSEMBLY

FIELD OF THE DISCLOSURE

The disclosure relates generally to a lid for liquid containers, and more particularly, to a re-closable lid for liquid containers, the re-closable lid sequentially opening a vent hole before opening a drink hole when a portion of the lid is rotated.

BACKGROUND

Refillable beverage containers, such as commuter coffee mugs, for example, typically include a removable lid that includes a fluid aperture or drink hole, and a consumer typically fills the interior of the container (e.g., an insulated container) with a beverage (e.g., coffee) when the lid is removed. To drink the beverage, the consumer typically tips the container to allow the beverage to pass through the drink hole, and the consumer sips the beverage as the beverage exits the drink hole. Because the beverage may be very hot, it is desired to prevent the beverage from spilling out of the drink hole if the container is accidentally tipped. Accordingly, refillable beverage containers can include a selective locking device on the lid that allows fluid to pass through the drink hole only when the locking device is in a desired position. A typical locking mechanism includes a lever or button that is displaced by the consumer prior to (or while) sipping the beverage. However, if such a refillable beverage container is carried in a bag with other items, contact between the items within the bag and the lever or button may accidentally disengage the locking mechanism and cause the beverage to pass through the fluid aperture and onto the items in the bag. Moreover, typical refillable beverage containers have a drinking area adjacent to or surrounding the drink hole that can become dirty with contact from the debris within the bag.

When a hot fluid is placed into the container and the locking mechanism is closed, vapor pressure can build up within the container. When the container is opened, this vapor build up forcefully exits the drink hole due to the internal-external pressure differential. As a result, a consumer can be injured by the exiting hot vapor. To solve this problem, some containers include vent holes to equalize the vapor pressure. However, current containers have vent holes that are always open, which can cause spillage out of the vent hole, or vent holes that are opened simultaneously with the drink hole when the lock is released, which may allow the vapor pressure to vent out of both the vent hole and the drink hole at the same time, again potentially putting the consumer at risk of injury.

BRIEF SUMMARY OF THE DISCLOSURE

A liquid container lid includes a seal arm assembly that stages opening and closing of a vent hole relative to a drink hole so that vapor within the liquid container may be vented to the atmosphere before the drink hole is opened. As a result, the disclosed liquid container lid and seal arm assembly advantageously reduce or eliminate the possibility of a consumer being injured by the hot vapor exiting through the drink hole due to excess gas pressure within the liquid container. The seal arm assembly is operatively connected to a cap of the liquid container lid so that the seal arm assembly is actuated by rotation of the cap. More specifically, as the cap is turned in a first direction, the seal arm assembly opens the vent hole before opening the drink hole. Similarly, as the cap is turned in a second direction, the seal arm assembly closes the drink hole before closing the vent hole.

DETAILED DESCRIPTION

Figure 1:
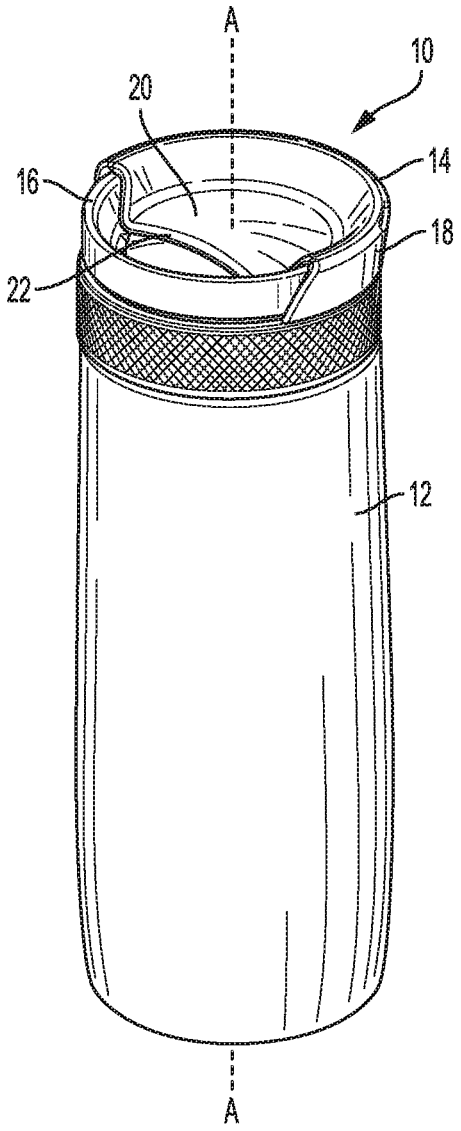
FIG. 1 is a perspective view of one embodiment of a lid having dual cammed seal arm assembly, the lid being removably secured to a container.

Turning now to FIG. 1, a lid 10 may be adapted to be removably secured to a container 12. The lid 10 includes a cap 14 that is rotatable relative to a base 16, the cap 14 being rotatable about a longitudinal axis A to cover or reveal a drink hole (not shown in FIG. 1). The cap 14 may include an outer skirt 18 that surrounds a perimeter of the base 16. The cap 14 may be generally annular in shape, with a recessed center surface 20. The cap 14 may also include a cut-out or access side 22 that is formed by removing a portion of the skirt 18. The access side 22 allows access to the drink hole when a consumer opens the lid 10 to extract fluid from the container 12. When the lid 10 is closed, the access side 22 is rotated away from the drink hole so that the recessed surface 20 is located over the drink hole to protect the drink hole from environmental factors, such as dirt or dust.

Generally, the lid includes a seal arm assembly that stages opening and closing of a vent hole relative to a drink hole so that vapor within the container may be vented to the atmosphere before the drink hole is opened. Thus, the seal arm assembly advantageously reduces or eliminates the possibility of a consumer being sprayed with hot vapor through the drink hole when the drink hole is opened, which could potentially injure the consumer. The seal arm assembly is operatively connected to the cap of the lid so that the seal arm assembly is actuated by rotation of the cap. More specifically, as the cap is turned in one direction, the seal arm assembly opens the vent hole before opening the drink hole. Similarly, as the cap is turned in a second direction, the seal arm assembly closes the drink hole before closing the vent hole. Operation of the seal arm assembly will be discussed in more detail below.

Figure 2:
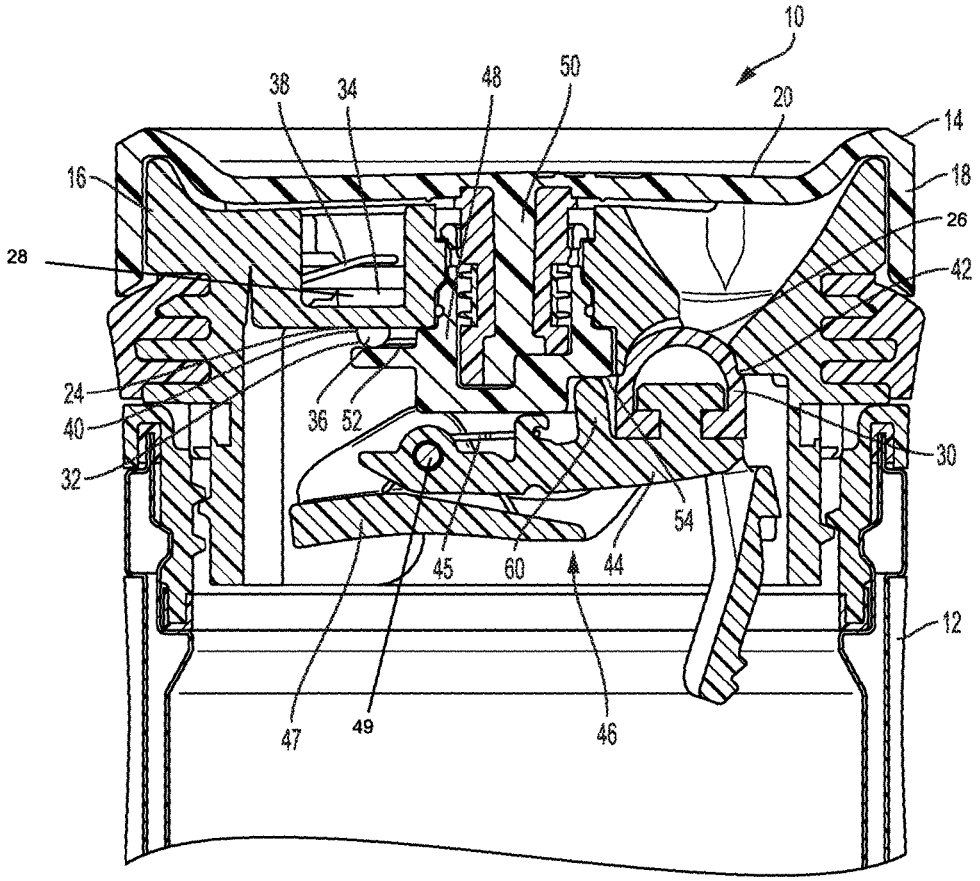
FIG. 2 is a cross-sectional view of the lid of FIG. 1.

Turning now to FIG. 2, a cross-sectional view of the lid 10 is illustrated. The lid 10 is removably attached to the container 12. In some embodiments, the lid 10 may be removably attached to the container by a threaded connection. In other embodiments, the lid 10 may be removably attached to the container 12 by a snap-on connection. Regardless, the lid 10 may be removed from the container 12 so that the container may be filled with a liquid for consumption.

The base 16 includes a vent hole 24 and a drink hole 26. Each of the vent hole 24 and the drink hole 26 fluidly connect the interior of the container 12 to the atmosphere. The vent hole 24 is selectively closed by a vent plug 28 and the drink hole 26 is selectively closed by a drink plug 30.

The vent plug 28 includes a body 32 having an annular upper portion 34 and a pin 36 extending away from the annular upper portion 34. The pin 36 extends into the vent hole 24 while the annular upper portion 34 is disposed outside of the container 12. In other words, a portion of the base 16 is located between the annular upper portion 34 and the container 12. The vent plug 28 may be biased to a closed position, in which the annular upper portion covers the vent hole 24, by a biasing element, such as a vent spring 38. The pin 36 provides an alignment mechanism by guiding the vent plug 28 into the correct position (by cooperation with the vent hole 24) during closing of the vent plug 28. In some embodiments, the pin 36 may have a distal guiding surface 40, such as a hemispherical end.

The drink plug 30 seats against a seating surface 42 in a bottom surface of the base 16 in a closed position. In the disclosed embodiment, the drink plug 30 has a hemispherical shape. In other embodiments, the drink plug 30 may have other shapes, so long as the drink plug 30 is capable of closing the drink hole 26. The drink plug 30 may be mounted at one end of a seal arm 44, which is part of a seal arm assembly 46. The seal arm 44 may be biased by a biasing element, such as a sealing arm spring 45, so that the drink plug 30 is biased towards a closed position. The seal arm assembly 46 includes the seal arm 44, and a rotatable cam 48. The seal arm 44 is pivotably mounted on an arm support 47 so that the seal arm 44 may rotate about a pivot point 49. The arm support 47 is secured to the base 16. In some embodiments, the arm support 47 may be integrally formed with the base 16.

The rotatable cam 48 may be operatively connected to the cap 14 by a cam post 50, which extends from a bottom surface of the cap 14. The cam post 50 translates rotational motion of the cap 14 into rotational motion of the rotatable cam 48. In other words, when a consumer rotates the cap 14, the rotatable cam 48 also rotates. As the rotatable cam 48 is rotated in a first direction, the vent plug 28 and the drink plug 30 are moved from a closed position to an open position. As the rotatable cam 48 is rotated in a second direction, the vent plug 28 and the drink plug 30 are moved from an open position to a closed position.

The rotatable cam 48 includes a first cam surface 52 and a second cam surface 54. The first cam surface 52 cooperates with the vent plug 28 to move the vent plug 28 between the open position and the closed position as the rotatable cam 48 rotates. Similarly, the second cam surface 54 cooperates with the seal arm 44 to move the drink plug 30 between the open position and the closed position as the rotatable cam 48 rotates. The first cam surface 52 and the second cam surface 54 are formed so that the vent plug 28 and the drink plug 30 are opened and closed sequentially. More specifically, when the rotatable cam 48 is rotated in the first direction, the vent plug 28 is urged towards the open position before the drink plug 30 is urged towards the open position. Similarly, when the rotatable cam 48 is rotated in the second direction, the drink plug 30 is allowed to close under the bias of the seal arm spring 45 before the vent plug 28 is allowed to close under the bias of the vent spring 38.

Figure 3:
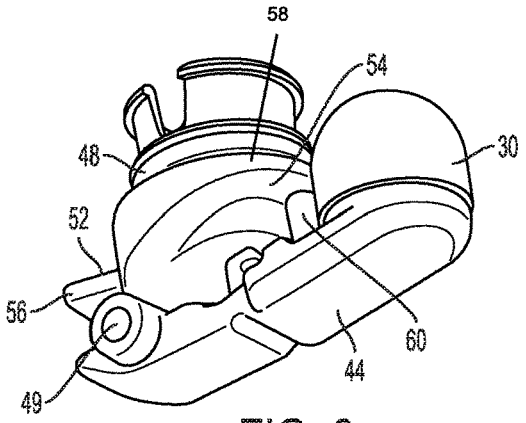
FIG. 3 is a perspective view of a seal arm assembly of the lid of FIG. 2.

Turning now to FIG. 3, a perspective view of the seal arm 44 and the rotatable cam 48 is illustrated. The first cam surface 52 is formed on a top or upper surface of a ledge 56. The second cam surface 54 is formed on a bottom or lower surface of an overhang 58. The first cam surface 52 cooperates with the vent plug 28 to open and close the vent plug 28, while the second cam surface 54 cooperates with the seal arm 44 to open and close the drink plug 30. More specifically, the second cam surface 54 cooperates with an arm post 60 that extends from the seal arm 44 to move the seal arm 44 about the pivot point 49, and thus, to open and close the drink plug 30. In the embodiment illustrated in FIG. 3, the first cam surface 52 may have a greater initial slope than the second cam surface 54 so that the vent plug 28 is moved before the drink plug 30 when the rotatable cam 48 is moved in the first direction.

Figure 4:
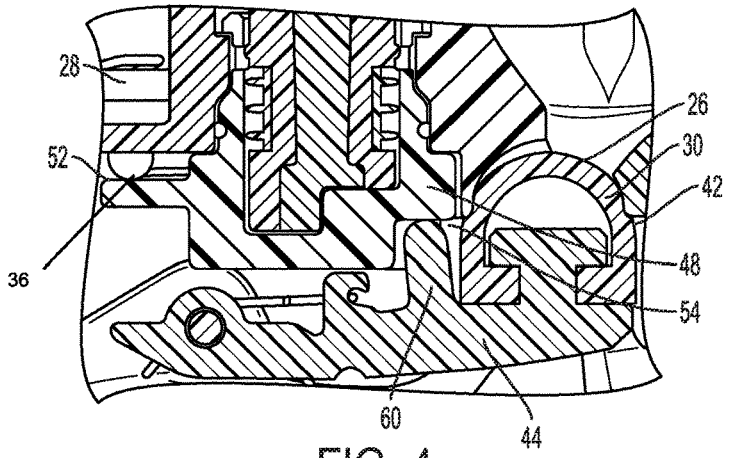
FIG. 4 is a cross-sectional view of the seal arm assembly of FIG. 3 in a closed position.
Figure 5:
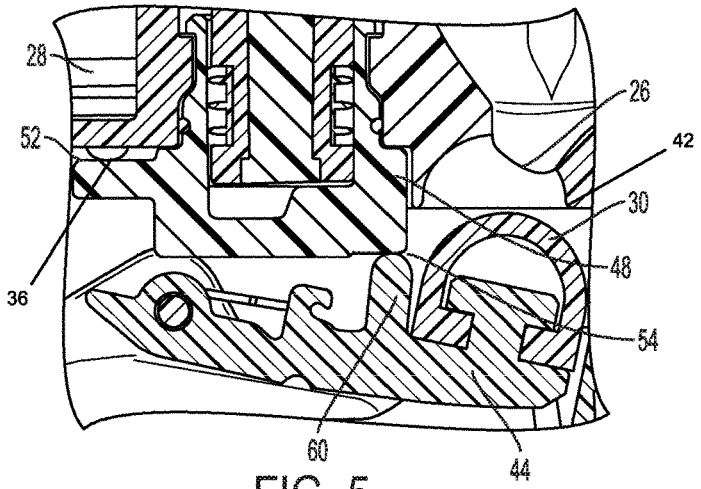
FIG. 5 is a cross-sectional view of the seal arm assembly of FIG. 3 in an open position.

Turning now to FIGS. 4 and 5, the rotatable cam 48 is illustrated in a closed position (FIG. 4), in which both the vent plug 28 and the drink plug 30 are in a closed position, and the rotatable cam 48 is illustrated in an open position (FIG. 5), in which both the vent plug 28 and the drink plug 30 are in an open position. As the rotatable cam 48 rotates in the first direction, the first cam surface 52 pushes up on the pin 36 of the vent plug 28 to open the vent plug 28. Similarly, as the rotatable cam 48 rotates in the first direction, the second cam surface 54 pushes down on the arm post 60, which rotates the seal arm 44 in a clockwise direction in FIGS. 4 and 5, thereby lowering the drink plug 30 away from the sealing surface 42 in the base 16 to open the drink hole 26.

Figure 6A:
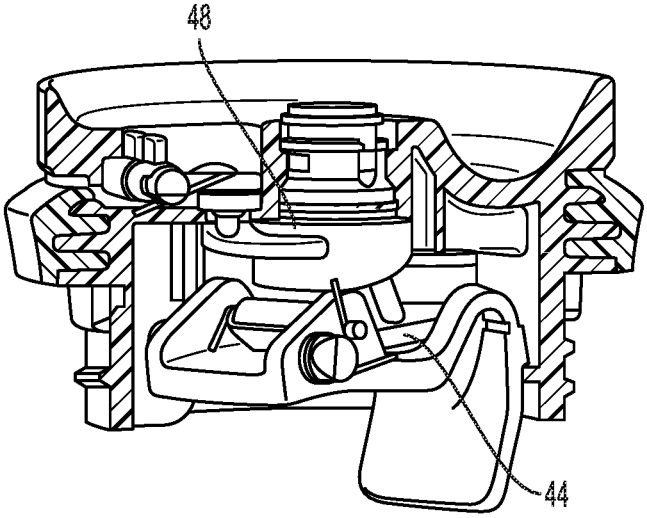
FIG. 6A is a perspective cross-sectional view of the seal arm assembly of FIG. 3 with a vent valve in a closed position.
Figure 6B:
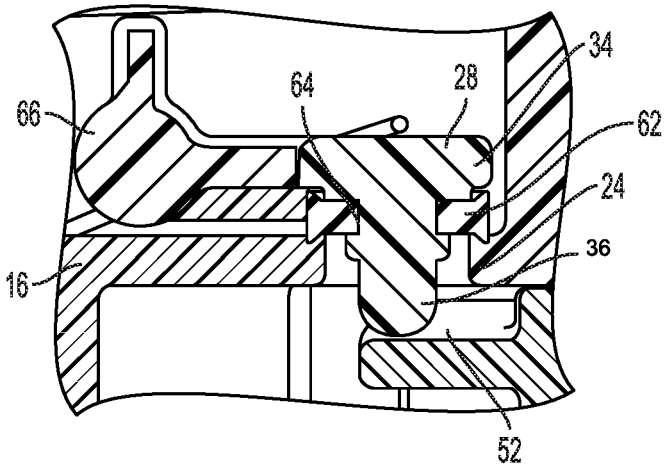
FIG. 6B is a close up cross-sectional view of the vent valve of FIG. 6A.
Figure 6C:
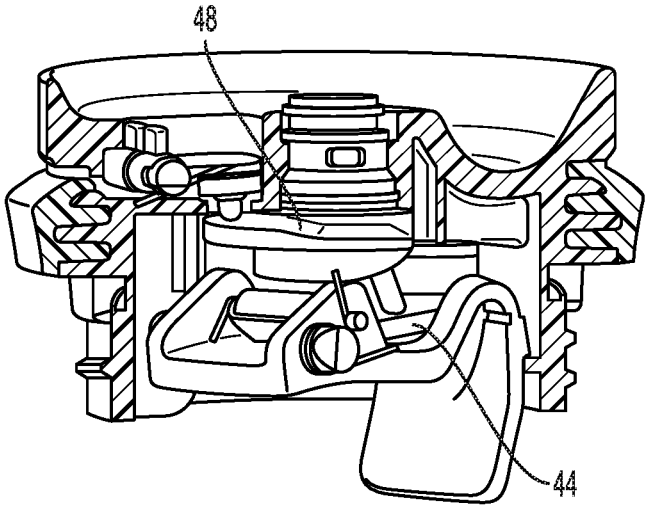
FIG. 6C is a perspective cross-sectional view of the seal arm assembly of FIG. 3 with a vent valve in an open position.
Figure 6D:
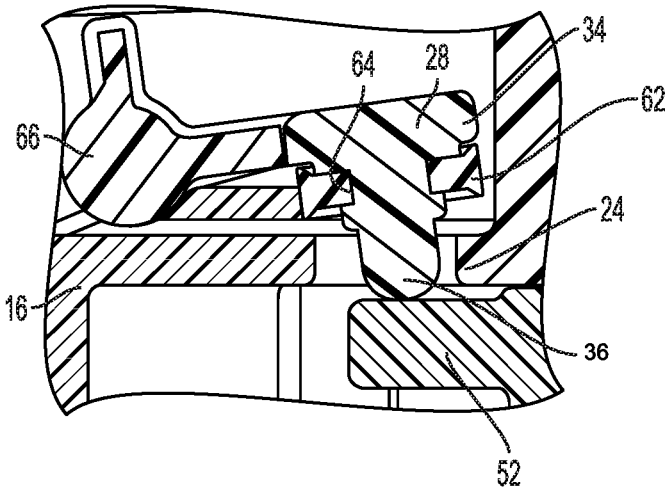
FIG. 6D is a close up cross-sectional view of the vent valve of FIG. 6C.
Figure 7A:
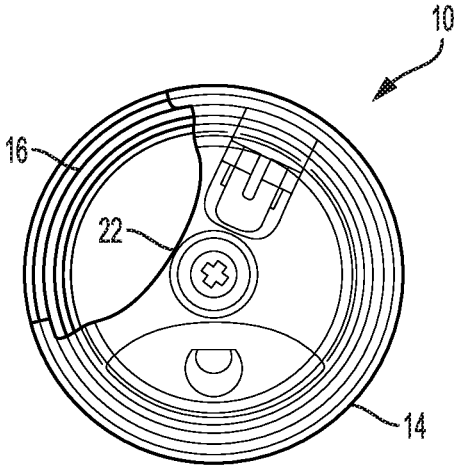
FIG. 7A is a top view of the lid of FIG. 3 in a closed position.
Figure 7B:
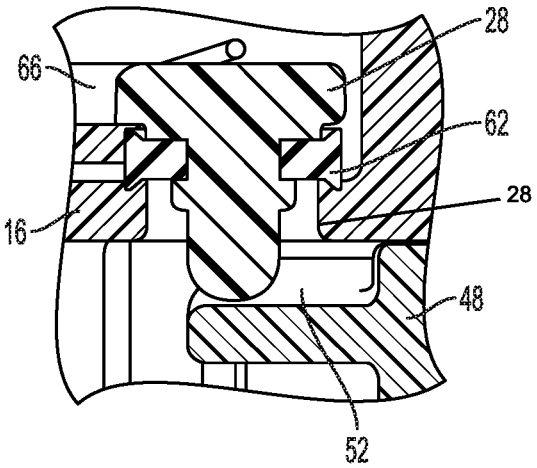
FIG. 7B is a cross-sectional view of the vent valve of the lid in a closed position, corresponding to the closed position of the lid in FIG. 7A.

FIGS. 6A and 6B illustrate the seal arm assembly 46 and the vent plug 28 in the closed position and FIGS. 6C and 6D illustrate the seal arm assembly 46 and the vent plug 28 in the open position. In the closed position, the vent plug 28 prevents fluid from flowing through the vent hole 24. To enhance the seal in the closed position, the vent plug 28 may include a sealing element, such as an o-ring 62 disposed on the pin 36. The o-ring 62 may be located within an annular recess 64 on the pin 36. The o-ring 62 seats against the base 16 to close the vent hole 24 when the vent plug 28 is in the closed position (FIGS. 6A and 6B). The o-ring 62 is spaced apart from the base 16 to open the vent hole 24 when the vent plug 28 is in the open position (FIGS. 6C and 6D). The vent plug 28 is mounted on a vent arm 66, which is pivotably attached to the base 16. As the first cam surface 52 pushes up on the pin 36 when the rotatable cam 48 is rotated in the first direction, the vent arm 66 pivots counterclockwise in FIGS. 6A to 6D, which raises the vent plug 28, and thus the o-ring 62, off of the base 16, thereby opening the vent hole 24. The reverse occurs when the rotatable cam 48 is rotated in the second direction.

FIGS. 7-10 illustrate an opening sequence for the lid 10. In FIGS. 7A and 7B, the lid 10 is in a closed position. The access side 22 of the cap 14 is located over a benign portion of the base 16 and the drink hole 26 is covered by the cap 14. The vent plug 48 is in the closed position in which the vent hole 28 is covered by the o-ring 62.

Figure 8A:
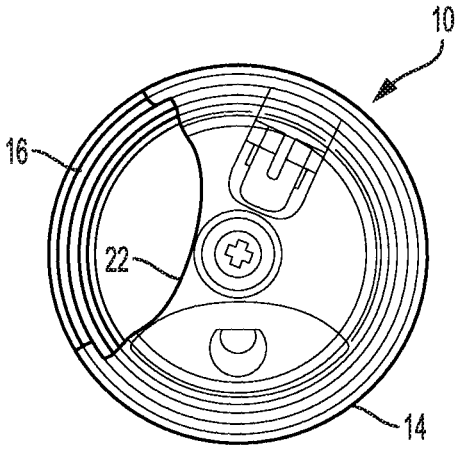
FIG. 8A is a top view of the lid of FIG. 3 in a first intermediate position in which the vent valve is beginning to open but the seal arm remains closed.
Figure 8B:
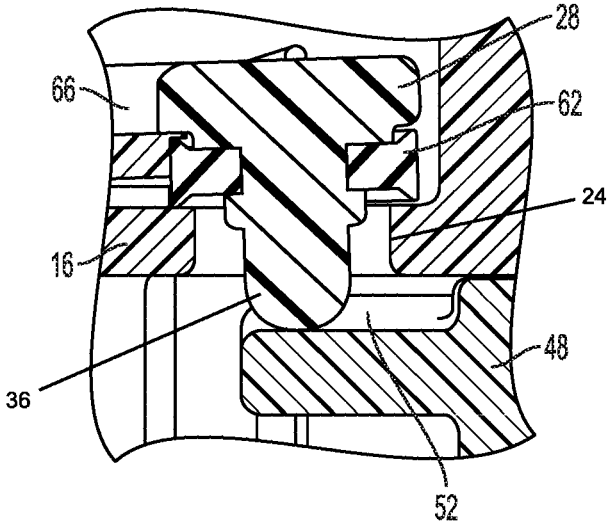
FIG. 8B is a cross-sectional view of the vent valve of the lid corresponding to the first intermediate position of the lid in FIG. 8A.

In FIGS. 8A and 8B, the lid 10 is in a first intermediate position. The access side 22 of the cap 14 has been rotated in a first direction (counterclockwise in FIGS. 7-10), between about 10 degrees and about 20 degrees from the position in FIG. 7A. As the cap 14 is rotated, the rotatable cam 48 is also rotated, which causes the first cam surface 52 to push up on the pin 36, causing the vent arm 66 to pivot and the vent plug 28 to begin to separate from the vent hole 24. At this stage, the second cam surface 54 has not yet begun to move the seal arm 44 (FIGS. 4 and 5).

Figure 9A:
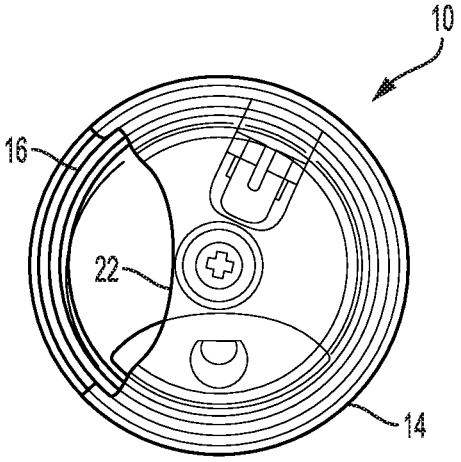
FIG. 9A is a top view of the lid of FIG. 3 in a second intermediate position in which the vent valve is open and the seal arm is beginning to open.
Figure 9B:
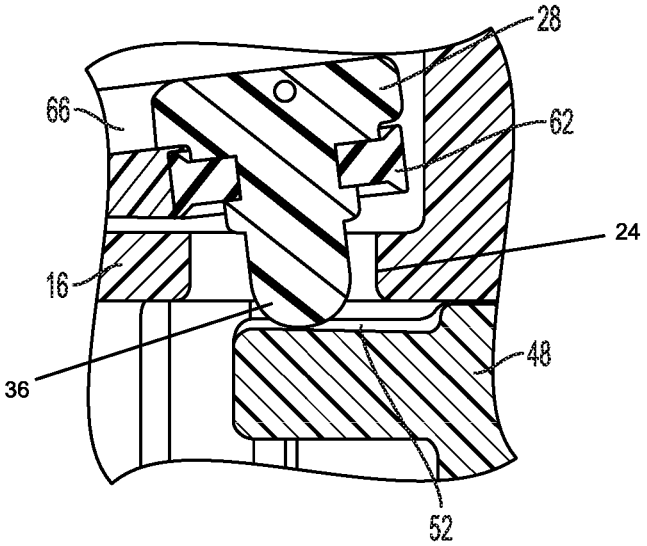
FIG. 9B is a cross-sectional view of the vent valve of the lid corresponding to the second intermediate position of the lid in FIG. 9A.

In FIGS. 9A and 9B, the lid 10 is in a second intermediate position. The access side 22 of the cap 14 has been rotated in the first direction (counterclockwise in FIGS. 7-10), between about 30 degrees and about 45 degrees from the position in FIG. 7A. As the cap 14 is rotated, the rotatable cam 48 is also rotated, which causes the first cam surface 52 to push up on the pin 36, causing the vent arm 66 to pivot and the vent plug 28 to continue to separate from the vent hole 24, until the vent plug 28 is in the fully open position. In this position, the second cam surface 54 has begun to move the vent arm 44 so that the drink plug 30 begins to separate from the sealing surface 42 (FIGS. 4 and 5).

Figure 10A:
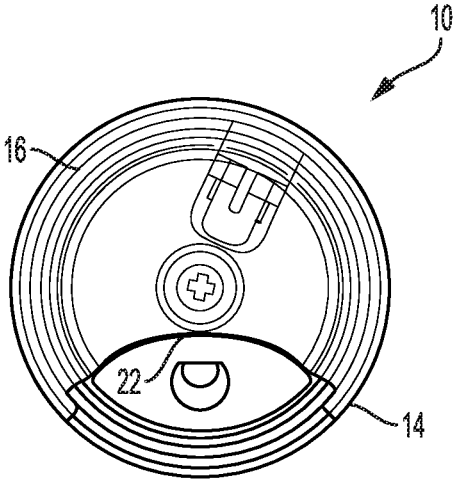
FIG. 10A is a top view of the lid of FIG. 3 in a fully open position in which the vent valve is to open and the seal arm is open.
Figure 10B:
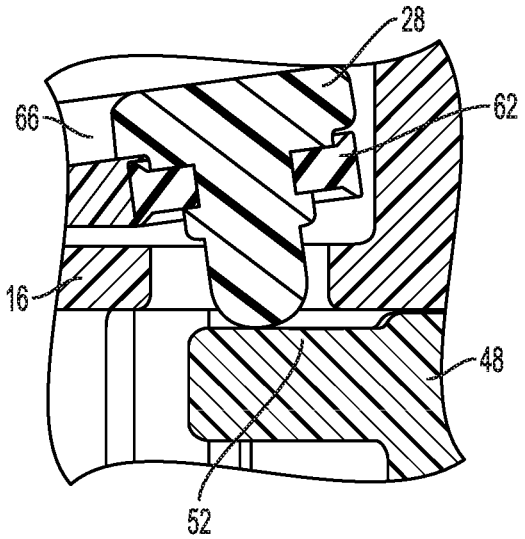
FIG. 10B is a cross-sectional view of the vent valve of the lid corresponding to the fully open position of the lid in FIG. 10A.

In FIGS. 10A and 10B, the lid 10 is in the fully open position. The access side 22 of the cap 14 has been rotated in the first direction (counterclockwise in FIGS. 7-10), between about 75 degrees and about 135 degrees from the position in FIG. 7A. As the cap 14 is rotated, the rotatable cam 48 is also rotated. However, because the vent plug 28 was already placed in the fully open position in FIGS. 9A and 9B, the first cam surface 52 does not continue to open the vent plug 28. Similarly, the seal arm 44 has reached the fully open position as well.

The disclosed lid advantageously sequentially opens a vent hole before opening a drink hole to prevent pressurized vapor within a container from forcefully exiting the drink hole as a consumer begins to drink from the container. The vent hole is sequentially opened first through the rotation of a cap in the lid and a rotatable cam having two different cam surfaces.

While various embodiments have been described above, this disclosure is not intended to be limited thereto. Variations can be made to the disclosed embodiments that are still within the scope of the appended claims.

What is claimed is:

1. A lid for a liquid container, the lid comprising:

a base that is configured for removable attachment to a container, the base including a vent hole and a drink hole;

a cap rotatably attached to the base;

a vent plug that selectively opens and closes the vent hole; and a seal arm assembly having a seal arm that is pivotably movable about a pivot point and a rotatable cam having a first cam surface and a second cam surface, wherein the first cam surface cooperates with the vent plug to move the vent plug to an open position when the cap is rotated in a first direction and the second cam surface cooperates with the seal arm to pivot the seal arm when the cap is rotated in the first direction, the first cam surface causing the vent plug to open before the second cam surface causes the seal arm to open when the cap is rotated in the first direction.

2. The lid of claim 1, wherein the vent plug includes an annular upper portion and a pin extending away from the annular upper portion, the pin extending at least partially into the vent hole.

3. The lid of claim 2, wherein the pin guides the vent plug into a closed position by cooperating with the vent hole.

4. The lid of claim 3, wherein the pin includes a distal guiding surface.

5. The lid of claim 1, wherein the vent plug is biased towards a closed position by a biasing element.

6. The lid of claim 1, further comprising a drink plug located on the seal arm.

7. The lid of claim 6, wherein the drink plug cooperates with a sealing surface on the base to close the drink hole.

8. The lid of claim 1, further comprising a cam post extending from a bottom surface of the cap, the cam post engaging the rotatable cam to rotate the rotatable cam when the cap is rotated.

9. The lid of claim 1, further comprising an arm support fixed to the base, the seal arm being pivotably attached to the arm support.

10. The lid of claim 6, wherein the drink plug has a hemispherical shape.

11. The lid of claim 1, wherein the first cam surface has a greater initial slope than the second cam surface.

12. The lid of claim 1, wherein the first cam surface is formed on an upper surface of a ledge.

13. The lid of claim 1, wherein the second cam surface is formed on a lower surface of an overhang.

14. The lid of claim 1, the seal arm assembly further comprising an arm post extending away from the seal arm, the arm post contacting the second cam surface.

* * * * *